US005857641A

United States Patent [19]

Goode

[11] Patent Number: 5,857,641

[45] Date of Patent: Jan. 12, 1999

[54] WINDING CORE HAVING INTEGRAL ENTANGLING MECHANISM

[75] Inventor: Vonnie L. Goode, Horse Shoe, N.C.

[73] Assignee: Kimberly-Clark WorldWide, Inc., Neenah, Wis.

[21] Appl. No.: 868,169

[22] Filed: Jun. 3, 1997

[51] Int. Cl.[6] ..... B65H 75/28

[52] U.S. Cl. ..... 242/583

[58] Field of Search ..... 242/583, 584, 242/579, 532, 532.2, 125.1, 613; 492/29, 30, 37

[56] References Cited

U.S. PATENT DOCUMENTS

| | | | |
|---|---|---|---|
| 2,095,123 | 10/1937 | Carkhuff . | |
| 2,318,056 | 5/1943 | Christman . | |
| 2,332,371 | 9/1943 | Corbin et al. . | |
| 2,361,264 | 10/1944 | Christman . | |
| 3,128,057 | 4/1964 | Barnhart et al. . | |
| 3,226,799 | 1/1966 | Grodberg et al. | 492/29 |
| 3,341,144 | 9/1967 | Mase . | |
| 3,345,009 | 10/1967 | Rockstrom . | |
| 3,489,371 | 1/1970 | Smith | 242/583 |
| 3,524,779 | 8/1970 | Masters et al. . | |
| 3,692,618 | 9/1972 | Dorschner et al. . | |
| 3,765,615 | 10/1973 | Brink et al. . | |
| 3,796,388 | 3/1974 | Davis . | |
| 3,802,817 | 4/1974 | Matsuki et al. . | |
| 3,808,657 | 5/1974 | Menges et al. | 492/29 |
| 3,876,165 | 4/1975 | Comer | 242/125.1 |
| 3,899,892 | 8/1975 | Melead . | |
| 3,948,457 | 4/1976 | Spreitzer | 242/583 |
| 3,967,795 | 7/1976 | Shindo et al. | 242/125.1 |
| 3,986,680 | 10/1976 | Cardell | 242/125.1 |
| 3,994,396 | 11/1976 | Reilly et al. . | |
| 4,285,480 | 8/1981 | Parker | 242/532 |
| 4,340,563 | 7/1982 | Appel et al. . | |
| 4,359,938 | 11/1982 | Koren | 492/29 |
| 4,492,012 | 1/1985 | Pala et al. | 492/29 |
| 4,783,019 | 11/1988 | Schmidt et al. | 242/583 |
| 4,842,213 | 6/1989 | Bartschi et al. | 242/125.1 |
| 4,893,762 | 1/1990 | Kuhn . | |
| 4,903,907 | 2/1990 | Yokajty et al. . | |
| 4,978,406 | 12/1990 | Nakano . | |
| 5,014,924 | 5/1991 | Nowisch et al. . | |
| 5,211,354 | 5/1993 | Rummage | 242/125.1 |
| 5,273,222 | 12/1993 | Hutzenlaub et al. . | |

FOREIGN PATENT DOCUMENTS

| | | | |
|---|---|---|---|
| 1952385 | 4/1971 | Germany | 242/583 |
| 5058560 | 3/1993 | Japan | 242/583 |
| 7116073 | 5/1995 | Japan . | |
| 2252761 | 8/1992 | United Kingdom | 242/583 |

*Primary Examiner*—John M. Jillions
*Attorney, Agent, or Firm*—Speckman Pauley Petersen & Fejer

[57] ABSTRACT

A winding core useful for winding and storing a nonwoven web or other fabric material includes a main core body and a mechanical entangling mechanism disposed on an outer surface of the core body. The mechanical entangling mechanism ensnares an end of the nonwoven web and holds it in place on the winding core during the initial winding of the web around the core.

27 Claims, 2 Drawing Sheets

WINDING CORE HAVING INTEGRAL ENTANGLING MECHANISM

FIELD OF THE INVENTION

This invention relates to a winding core useful for storing nonwoven webs and other fabrics in the form of a roll. More specifically, the invention relates to a winding core having an entangling mechanism for grabbing the tail end of a nonwoven web or other fabric to facilitate the initial winding of the fabric.

BACKGROUND OF THE INVENTION

Various mechanisms are known in the art for holding the tail end of a fabric or paper to a winding roll, to prevent separation of the fabric or paper from the roll during the initial winding. U.S. Pat. No. 5,014,924, issued to Nowisch et al., discloses using water jets to wet the end of a web material, facilitating temporary adhesion between the web end and a winding core. The use of an adhesive to bond the tail end of a paper or web to a winding roll is disclosed in U.S. Pat. Nos. 3,994,396 (Reilly et al.); 3,765,615 (Brink et al.); 3,524,779 (Masters et al.); 3,128,057 (Barnhart et al.). The use of static electricity to adhere the tail end of a web to a spool is disclosed in U.S. Pat. Nos. 5,273,222 (Hutzenlaub et al.); 3,899,892 (Melead); and 3,345,009 (Rockstrom).

U.S. Pat. No. 4,893,762 (Kuhn) discloses using glue, pins, or another similar method to mount one end of a web strip to a winding tube. U.S. Pat. No. 4,978,406 (Nakano) discloses a tube member covered with a lining. U.S. Pat. No. 2,318,056 (Christman) discloses applying suction to a perforated or slotted core in order to hold toilet paper or paper towels to the core during winding. U.S. Pat. No. 3,769,388 (Davis) discloses heat bonding one end of a sheet to an empty core. U.S. Pat. No. 2,095,123 (Carkhuff) discloses a knife gripper with serrated tooth edges that grabs and penetrates one end of a paper sheet as it is being wound.

For polymeric nonwoven webs and other polymeric fabrics, adhesives (e.g., in the form of adhesive tapes) have typically been used to bond the web ends to the winding cores. Adhesive tapes useful for bonding plastic fabrics are generally expensive, and are hard to remove when the fabrics are unwound. Also, nonwoven webs are commonly used in medical gowns, personal care products including diapers and adult care products, and other human contact applications. Accordingly, any adhesive which comes into contact with the nonwoven webs must pass close scrutiny and meet strict regulatory guidelines. There is a need or desire for a mechanism to initiate the winding of nonwoven webs onto the winding cores without requiring contact with adhesives or other chemicals.

DEFINITIONS

As used herein, the term "nonwoven web" means a web that has a structure of individual fibers or threads which are interlaid, but not in an identifiable repeating manner. Nonwoven webs have been, in the past, formed by a variety of processes such as, for example, meltblowing processes, spunbonding processes and bonded carded web processes.

As used here, the term "microfibers" means small diameter fibers having an average diameter not greater than about 100 microns, for example, having a diameter of from about 0.5 microns to about 50 microns, more specifically microfibers may also have an average diameter of from about 4 microns to about 40 microns.

As used herein, the term "interfiber bonding" means bonding produced by entanglement between individual meltblown fibers to form a coherent web structure without the use of thermal bonding. This fiber entangling is inherent in the meltblown processes but may be generated or increased by processes such as, for example, hydraulic entangling or needlepunching.

Alternatively and/or additionally, a bonding agent can be utilized to increase the desired bonding and to maintain structural coherency of the web. For example, powdered bonding agents and chemical solvent bonding may be used.

As used herein, the term "meltblown fibers" means fibers formed by extruding a molten thermoplastic material through a plurality of fine, usually circular, die capillaries as molten threads or filaments into a high velocity gas (e.g., air) stream which attenuates the filaments of molten thermoplastic material to reduce their diameters, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin, the disclosure of which is hereby incorporated by reference.

As used herein, the term "spunbonded fibers" refers to small diameter fibers which are formed by extruding a molten thermoplastic material as filaments from a plurality of fine, usually circular, capillaries in a spinnerette with the diameter of the extruded filaments then being rapidly reduced, for example, by eductive drawing or other well-known spun bonding mechanisms. The production of spunbonded nonwoven webs is illustrated in patents such as, for example, U.S. Pat. No. 4,340,563 to Appel et al., U.S. Pat. No. 3,802,817 to Matsuki et al., and U.S. Pat. No. 3,692,618 to Dorschner et al. The disclosures of both these patents are hereby incorporated by reference.

As used herein, the term "core" means a cylindrical object made of cardboard or another material, used for the winding of a nonwoven web into rolls. The core is located at the center of a nonwoven web roll.

As used herein, the term "entanglement mechanism" means any surface feature on the outer surface of a core which is capable of grabbing a nonwoven web. The entanglement mechanism may be a prickly outer surface formed by embossing or other means, a conventional hook-type fastener (e.g., Velcro-type strips) mounted to the outer surface of the core, or another nonadhesive-type surface feature. To qualify as an entanglement mechanism, the following test must be passed. A nonwoven web sample of the type being wound is pressed against the outer surface of the core. The web sample is then lifted off of the core. If the web exhibits any noticeable mechanical peeling (i.e., a tendency to mechanically stick to the core) while it is being lifted off, the surface feature causing the peeling qualifies as an entanglement mechanism. If the web exhibits no such peeling, but instead lifts off of the core without any resistance, the core surface does not embody an entanglement mechanism. To qualify as an entanglement mechanism, the level of peeling or resistance may be very low and can be barely noticeable. A low level of mechanical resistance is all that is required to maintain the nonwoven web on the core during initial winding of the roll. Also, what constitutes an entanglement mechanism may vary depending on the type of nonwoven web being wound. A surface feature suitable for grabbing or entangling one nonwoven web may not grab or entangle another different nonwoven web.

As used herein, the term "prickly outer surface" refers to a surface having protrusions which are of sufficient size, shape and number to grab or entangle a nonwoven web. The prickly outer surface may be formed by embossing a thick paper or thin cardboard with a pattern that substantially punctures the paper or cardboard to cause prickly protrusions on one surface of the paper or cardboard. Then, the paper or cardboard is laminated to the initially smooth surface of the core, for example using a glue, with the protrusions facing outward from the core.

SUMMARY OF THE INVENTION

The present invention is a winding core for a nonwoven web having an integrally formed entanglement mechanism on its outer surface capable of mechanically engaging and holding an end of the nonwoven web against the core to facilitate initial winding of the web around the core. By "integrally formed" it is meant that the entangling mechanism is a permanent part of the winding core. The invention also includes a combination of the core and a nonwoven web rolled around the core. The entanglement mechanism may be in the form of a prickly outer surface having a plurality of outward protrusions capable of engaging and holding an end of the nonwoven web during the initial winding, yet which peelably release the nonwoven web during unwinding. The entanglement mechanism may be in the form of a male or "hook" component of a hook-and-loop fastener, including without limitation one or more Velcro® strips. The entanglement mechanism may also be in the form of an embossed outer surface of the core, or an embossed outer member laminated to the surface of the core, provided that the embossing generates a "prickly outer surface," defined as protrusions of sufficient size and shape to entangle an end of the nonwoven web. The precise entanglement mechanism required may vary with the particular nonwoven web being wound.

With the foregoing in mind, it is a feature and advantage of the invention to provide a winding core for a nonwoven web that is capable of mechanically engaging and holding an end of the nonwoven web during the initial winding of the web.

It is also a feature and advantage of the invention to provide a winding core for a nonwoven web that does not require an adhesive, or adhesive tape, to hold an end of the nonwoven web in place during initial winding of the web.

It is also a feature and advantage of the invention to provide, in combination, a nonwoven web wound around a core wherein an end of the web is releasably engaged and held to an outer surface of the core without an adhesive.

The foregoing and other features and advantages of the invention will be apparent from the following detailed description of the presently preferred embodiments, read in conjunction with the accompanying drawings.

DETAILED DESCRIPTION OF THE PRESENTLY PREFERRED EMBODIMENTS

Figure 1:
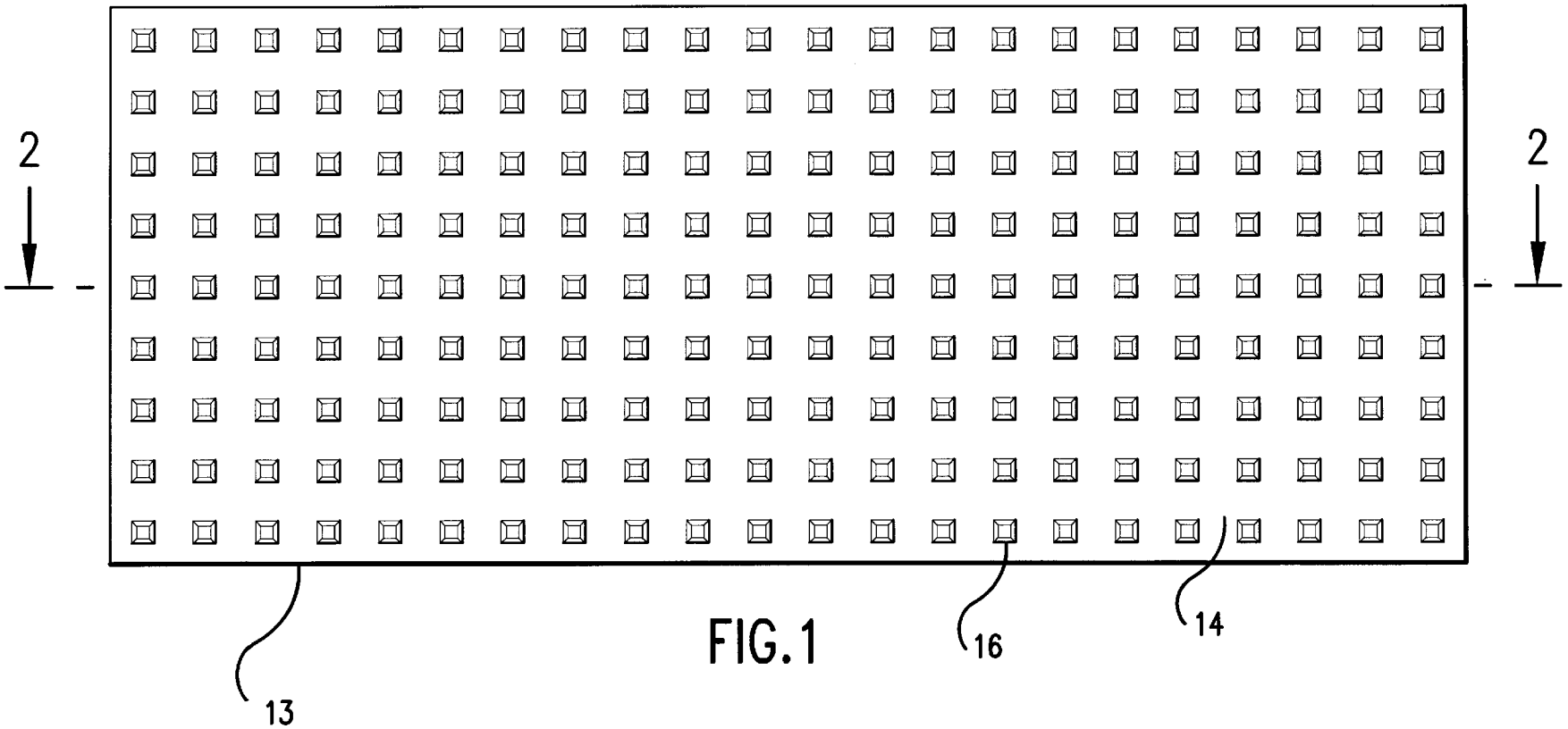
FIG. 1 is a plan view of a section of thick paper or thin cardboard which has been embossed to impart a prickly outer surface illustrated by the dots.
Figure 2:
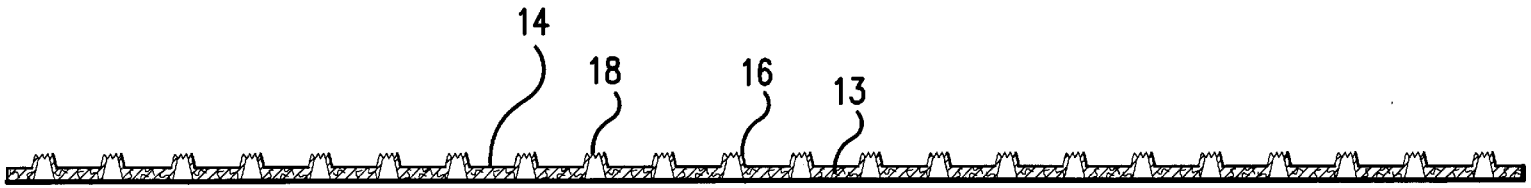
FIG. 2 is a side sectional view of the embossed paper or cardboard taken along the line 2—2 in FIG. 1.
Figure 3:
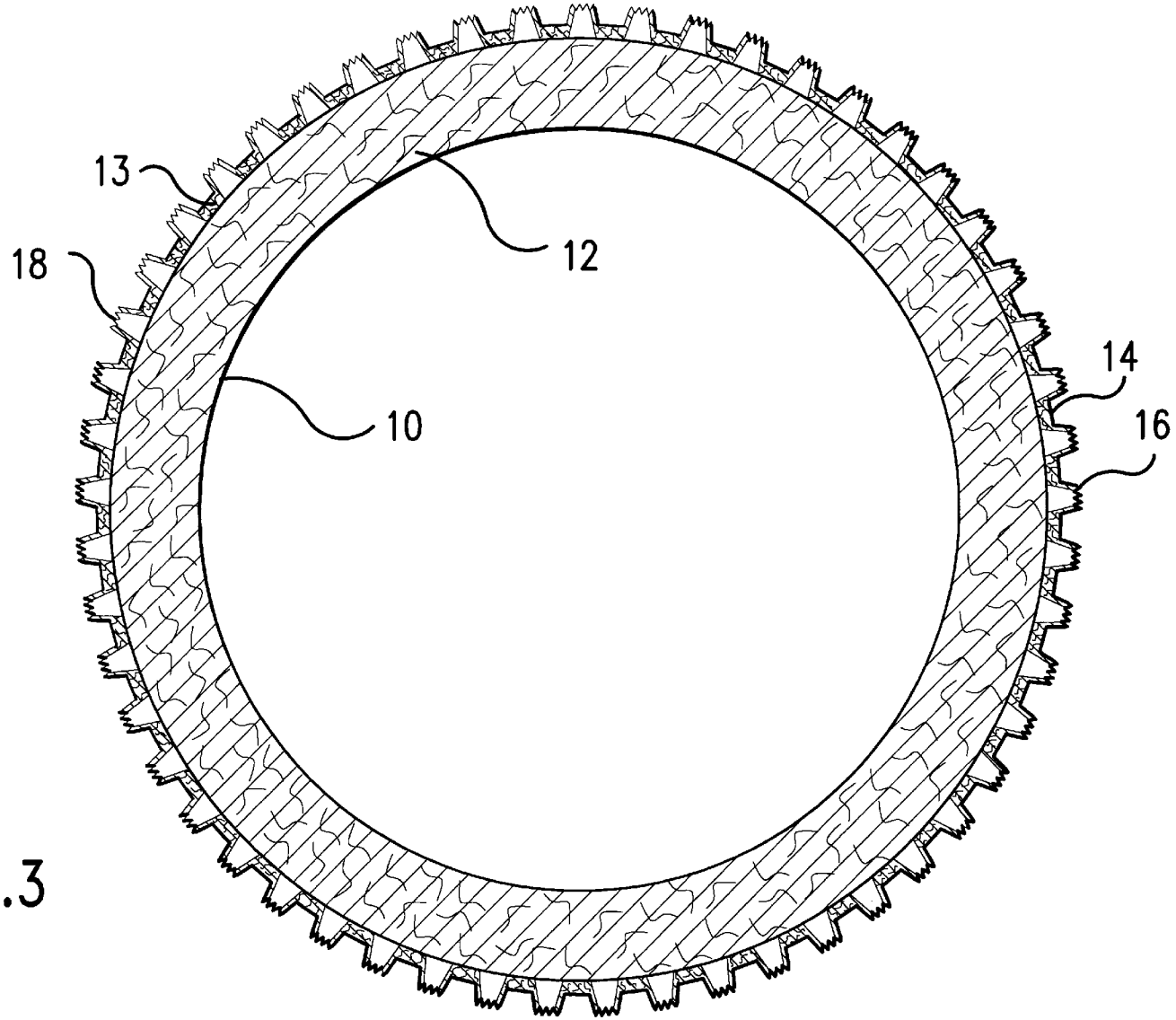
FIG. 3 is a side sectional view of a winding core embodying the embossed paper or cardboard of FIGS. 1 and 2 on its outer surface.

Referring to FIGS. 1–3, a winding core 10 having a hollow cylindrical configuration is useful for winding a nonwoven web into a roll. The winding core 10 has a rigid hollow cylindrical main body 12 which may be constructed, for example, from a stiff hardboard, cardboard or paperboard material. In one embodiment, for instance, the main body 12 is constructed of paperboard and has an inner hollow diameter of about 6.75 inches, an outer diameter of about 7.25 inches, a thickness of about 0.25 inch, and a width which is slightly larger than the width of nonwoven web to be wound. Suitable cores are available from Jefferson Smurfitt Company in Hendersonville, N.C.

The winding core 10 also has an entanglement mechanism on its outer surface. In the preferred embodiment illustrated, the entanglement mechanism is provided by an embossed layer 13 of thick paper or thin cardboard having an outer surface 14 that includes a plurality of spaced apart prickly protuberances 16. The prickly protuberances 16 can be formed by embossing the layer 13 with a pattern as shown in FIG. 1, or with another pattern. The embossing must be sufficient to puncture or nearly puncture the layer 13 so that the protuberances 16 have rough, jagged or prickly upper ends 18 capable of entangling and holding a nonwoven web in place on the outer surface of the winding core 10.

The embossed layer 13 can be laminated to the surface of the main body 12 using a suitable glue or other adhesive. Preferred glues include, for example, high solids content glues based on polyvinyl acetate, ethylene vinyl acetate, polyvinyl alcohol and acrylic polymers. One useful glue is Reynolds 3708B, available from the Reynolds Co. in Greenville, S.C. The glue may be applied at a thickness sufficient to permit a small amount of glue to penetrate the open ends 18 and dry in the vicinity of the open ends. The dried glue in the vicinity of open ends 18 will tend to make the surface 14 even more prickly. The glue must at least be applied in an amount sufficient to bond the layer 13 to the main body 12.

As stated above, the embossing must be sufficient to provide the protuberances 16 with rough, jagged or prickly open ends 18. The embossing must also produce a sufficient number of protuberances 16 having sufficient size to entangle and hold a nonwoven web in place. In the preferred embodiment shown, the protuberances 16 each have a semi-pyramidal or semi-conical shape. Each protuberance 16 has an average height of about 0.050 inch (measured from the end 18 to the main surface 14), a length and width of about 0.07 inch, and are spaced apart by about 0.25 inch in both perpendicular directions in the manner shown in FIG. 1. On average, there are about sixteen of the protuberances 16 per square inch of the outer surface 14.

Of course, some variations in the embossing pattern are permissible provided that the protuberances 16 serve as an entangling mechanism for holding the nonwoven web during the initial winding. Also, different embossing patterns may be preferred for different nonwoven webs. Generally, the average height of the protuberances 16 should range from about 0.03 inch to about 0.2 inch, preferably about 0.035 inch to about 0.1 inch, most preferably about 0.04 inch to about 0.07 inch. The shape of the protuberances 16 (as viewed from the top) may be square, cylindrical, rectangular, semi-pyramidal, semi-conical, or irregular, in addition to other shapes. The average length and width of each protuberance 16 (or diameter) should range from about 0.02 inch to about 0.2 inch, preferably about 0.04 inch to about 0.15 inch, most preferably about 0.05 inch to about 0.1 inch. The number of protuberances 16 per square inch of the outer surface 14 (i.e., the frequency) should range from about 1 to about 40, preferably about 5 to about 25, most preferably about 7 to about 15.

The (unembossed) thickness and grade of the paper or cardboard layer 13 should also be selected to provide protuberances 16 having sufficient stiffness and strength to entangle and maintain the nonwoven web. One suitable paper for the layer 13 is commercially available under the name Tac 95 from the Jefferson-Smurfitt Company located in Hendersonville, N.C. Tac 95 paper has a thickness of about 20 mils. Generally, the paper or cardboard thickness used in the layer 13 should range from about 10 to about 50 mils, preferably about 15 to about 30 mils.

Other materials can also be used for the patterned layer 13 instead of paper. Such other materials include aluminum foil (preferably a coarse grade), stiff polymer films which can be embossed with a permanent pattern, prickly fabrics, and the hook components of conventional hook-and-loop fasteners (for example, Velcro®). Also, the patterned layer 13 can be laminated to the main body 12 as a uniform layer as shown in the drawings, or can be laminated as individual spaced apart strips. When the hook component of a hook-and-loop fastener (e.g., Velcro®) is used as the entangling material, it may be sufficient to laminate individual strips or stripes of the entangling material to the main body 12 of the core 10, instead of covering and surrounding the entire outer surface of the main body 12. The main criterion that must be satisfied is that there is sufficient coverage of the main body 12 by the entangling mechanism to effectively entangle and hold an end of the nonwoven web in place on the core 10 during initial winding of the nonwoven web. In still another embodiment, a prickly pattern may be provided on the outer surface of the main body 12 of the core 10, avoiding the need for lamination.

Various types of nonwoven webs may be wound onto the winding core 10 of the invention. The webs may, for instance, be constructed of a wide variety of polymers including without limitation polyamides, polyesters, copolymers of ethylene and propylene, copolymers of ethylene or propylene with a $C_4$–$C_{20}$ alpha-olefin, terpolymers of ethylene with propylene and a $C_4$–$C_{20}$ alpha-olefin, ethylene vinyl acetate copolymers, propylene vinyl acetate copolymers, styrene-poly(ethylene-alpha-olefin) elastomers, polyurethanes, A–B block copolymers where A is formed of poly(vinyl arene) moieties such as polystyrene and B is an elastomeric midblock such as conjugated diene or lower alkene, polyethers, polyether esters, polyacrylates, ethylene alkyl acrylates, polyisobutylene, polybutadiene, isobutylene-isoprene copolymers, and combinations of any of the foregoing. The webs may also be constructed of bicomponent or biconstituent filaments or fibers, as are known to persons skilled in the art.

While the embodiments disclosed herein are presently considered preferred, various modifications and improvements can be made without departing from the spirit and scope of the invention. The scope of the invention is indicated by the appended claims, and all changes that fall within the meaning and range of equivalents are intended to be embraced therein.

I claim:

1. A combination including a winding core and a fibrous web in the form of a roll, the winding core comprising:

a main body; and an entanglement mechanism on an outer surface of the main body;

the entanglement mechanism being capable of mechanically engaging and holding the web against the core in a peelably releasable fashion;

the entanglement mechanism located in a region which substantially covers the outer surface of the main body.

2. The combination of claim 1, wherein the main body comprises a rigid hollow cylinder.

3. The combination of claim 1, wherein the entanglement mechanism comprises a plurality of prickly protuberances disposed on an outer surface of the winding core.

4. The combination of claim 1, wherein the entanglement mechanism comprises an embossed sheet laminated to the outer surface of the main body.

5. The combination of claim 4, wherein the embossed sheet comprises a plurality of prickly protuberances.

6. The combination of claim 4, wherein the embossed sheet comprises paper.

7. The combination of claim 4, wherein the embossed sheet comprises cardboard.

8. The combination of claim 4, wherein the embossed sheet comprises aluminum foil.

9. The combination of claim 4, wherein the embossed sheet comprises a polymer film.

10. The combination of claim 1, wherein the entanglement mechanism comprises a male component of a hook-and-loop fastener.

11. A combination including a winding core and a fibrous web on the winding core in the form of a roll, the winding core comprises:

a main cylindrical body; and a plurality of prickly protuberances disposed in the main cylindrical body;

the prickly protuberances located in a region which substantially covers an outer surface of the main cylindrical body.

12. The combination of claim 11, wherein the prickly protuberances are formed directly on an outer surface of the main cylindrical body.

13. The combination of claim 11, wherein the prickly protuberances are formed in a sheet is laminated to an outer surface of the main cylindrical body.

14. The combination of claim 13, wherein the sheet is laminated to the main cylindrical body using glue.

15. The combination of claim 14, wherein some of the glue penetrated the sheet through the prickly protuberances.

16. The combination of claim 11, wherein the protuberances have an average height of about 0.03 inch to about 0.2 inch.

17. The combination of claim 11, wherein the protuberances have an average height of about 0.035 inch to about 0.1 inch.

18. The combination of claim 11, wherein the protuberances have an average height of about 0.04 inch to about 0.07 inch.

19. The combination of claim 11, wherein the protuberances are disposed in the main cylindrical body at a frequency of about 1 to about 40 protuberances per square inch.

20. The combination of claim 19, wherein the frequency of protuberances is about 7 to about 15 per square inch.

21. The combination of claim 19, wherein the frequency of protuberances is about 7 to about 15 per square inch.

22. A combination of a winding core and a fibrous web, comprising:

a winding core having a main cylindrical body and a mechanical entangling mechanism disposed in an outer surface of the body; and a fibrous web wrapped around the winding core;

the mechanical entanglement mechanism substantially covering the outer surface of the body.

23. The combination of claim 22, wherein the nonwoven web comprises a spunbonded web.

24. The combination of claim 22, wherein the nonwoven web comprises a meltdown web.

25. The combination of claim 22, wherein the mechanical entangling mechanism comprises a patterned sheet laminated to the main cylindrical body.

26. The combination of claim 22, wherein the mechanical entangling mechanism comprises a plurality of spaced apart prickly protuberances.

27. The combination of claim 22, wherein the mechanical entangling mechanism comprises a male component of a hook-and-loop fastener.

* * * * *

UNITED STATES PATENT AND TRADEMARK OFFICE

CERTIFICATE OF CORRECTION

PATENT NO : 5,857,641

DATED : 12 January 1999

INVENTOR(S) : Vonnie L. GOODE

It is certified that error appears in the above-identified patent and that said Letters Patent is hereby corrected as shown below:

In Column 7, Claim 24, delete "meltdown" and in its place insert:

--meltblown--.

Signed and Sealed this

Third Day of August, 1999

*Attest:*

Q. TODD DICKINSON

*Attesting Officer*

*Acting Commissioner of Patents and Trademarks*